US006056917A

United States Patent [19]

Chesseret et al.

[11] Patent Number: 6,056,917

[45] Date of Patent: May 2, 2000

[54] AUSTENITIC STAINLESS STEEL HAVING A VERY LOW NICKEL CONTENT

[75] Inventors: Laurent Chesseret, Bellenaves; Jean-Michel Hauser, Ugine, both of France

[73] Assignees: Usinor, Puteaux; Ugine Savoie, Ugine, both of France

[21] Appl. No.: 09/124,750

[22] Filed: Jul. 29, 1998

[30] Foreign Application Priority Data

Jul. 29, 1997 [FR] France ..... 97 09617

[51] Int. Cl.[7] ..... C22C 38/20; C22C 38/38

[52] U.S. Cl. ..... 420/60; 420/41; 420/61; 420/64; 148/325

[58] Field of Search ..... 420/41, 60, 61, 420/64; 148/325

[56] References Cited

U.S. PATENT DOCUMENTS 3,756,807 9/1973 Hoshino et al. ..... 420/58

FOREIGN PATENT DOCUMENTS 2 071 667 9/1971 France .
2 074 865 10/1971 France .
538055 12/1976 U.S.S.R. .
1070465 6/1967 United Kingdom ..... 420/6

*Primary Examiner*—Deborah Yee
*Attorney, Agent, or Firm*—Oblon, Spivak, McClelland, Maier & Neustadt, P.C.

[57] ABSTRACT

Austenitic stainless steel having a very low nickel content, of the following composition by weight:

Carbon<0.1%
0.1%<silicon<1%
5%<manganese<9%
0.1%<nickel<2%
13%<chromium<19%
1%<copper<4%
0.1%<nitrogen<0.40%
$5\times10^{-4}$%<boron<$50\times10^{-4}$%
phosphorus<0.05%
sulfur<0.01%.

18 Claims, 1 Drawing Sheet

AUSTENITIC STAINLESS STEEL HAVING A VERY LOW NICKEL CONTENT

BACKGROUND OF THE INVENTION

1. Field of the Invention

The invention relates to an austenitic stainless steel having a very low nickel content.

2. Background of the Invention

Stainless steels are classified into large families depending on their metallurgical structure. Austenitic steels are steels generally having a nickel content greater than 3% in their composition by weight. For example, an NF EN 10 088 standard No. 1.4301 austenitic steel (AISI 304) has more than 8% nickel in its composition.

The high cost of the element nickel and the uncontrollable variations in its price have led steelmakers to develop austenitic steels whose composition does not contain nickel or else contains very little of it. International directives are aimed at reducing the release of nickel from materials, especially in the water and skin-contact fields.

SUMMARY OF THE INVENTION

One object of the invention is to provide an austenitic steel having a very low nickel content, with, in particular, mechanical and welding properties which are equivalent, and even superior, to those of austenitic steels having a high nickel content.

The subject of the invention is an austenitic steel having a very low nickel content, whose composition comprises the following elements in amount by weight based on total weight:

carbon<0.1%

0.1%<silicon<1%

5%<manganese<9%

0.1%<nickel<2%

13%<chromium<19%

1%<copper<4%

0.1%<nitrogen<0.40%

$5\times10^{-4}$%<boron<$50\times10^{-4}$% phosphorus<0.05% sulfur<0.01% and iron and impurities resulting from smelting.

Other characteristics of the invention, which may be present singularly or in any combination, are:

the composition satisfies the relationship which defines a ferrite index $FI_1$:

$$FI_1=0.034x^2+0.284x-0.347<20,$$

where $$x=6.903[-6.998+Cr\ \%-0.972(Ni\ \%+21.31\ N\ \%+20.04C\ \%+0.46Cu\ \%+0.08Mn\ \%)];$$

the composition satisfies the following relationship, using a martensite stability index SI:

$$SI=0.0267x^2+0.4332x-3.1459<20,$$

where $$x=250.4-205.4C\ \%-101.4N\ \%-7.6Mn\ \%-12.1Ni\ \%-6.1Cr\ \%-13.3Cu\ \%;$$

the steel contains, in its composition, less than 1% nickel;

from 15 to 17% chromium;

less than 0.08% carbon;

from 0.5% to 0.7% silicon;

less than 2% molybdenum;

less than 0.0020% sulfur; and the steel furthermore contains in its composition less than 0.030% aluminum, preferably less than $50\times10^{-4}$% aluminum and less than $20\times10^{-4}$% calcium and preferably less than $5\times10^{-4}$% calcium.

The description which follows, together with the appended FIGURE, all given by way of nonlimiting example, will make the invention more clearly understood.

DETAILED DESCRIPTION OF THE INVENTION

Figure 1:
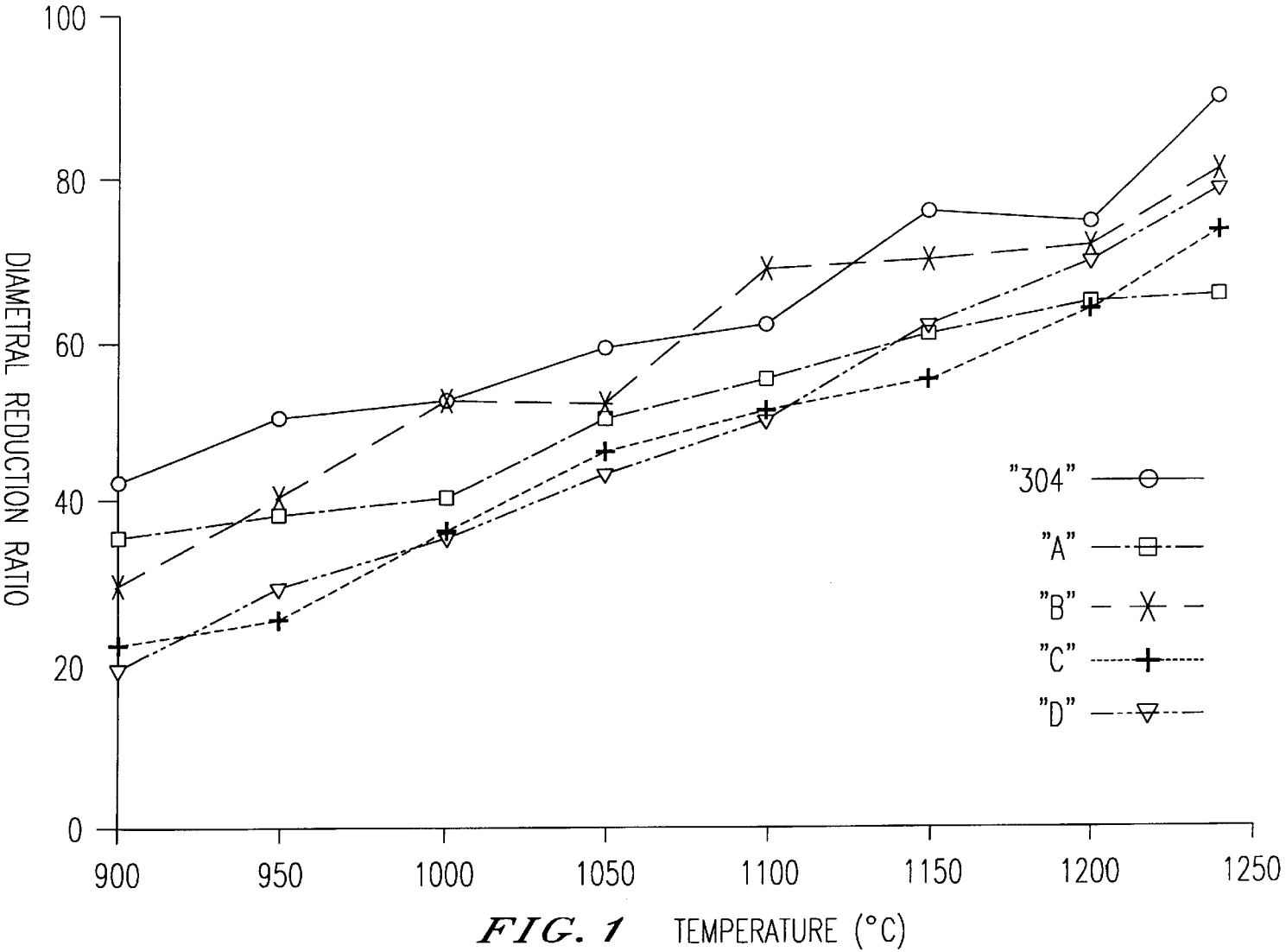
FIG. 1 shows the reduction-in-section characteristics as a function of temperature for various steels.

The austenitic steel according to the invention is smelted, with the nickel content of the composition being limited. The austenizing effect, usually attributed to the element nickel, must preferably be compensated for by gammagenic elements, such as manganese, copper, nitrogen and carbon, and it is preferable to reduce as far as possible the contents of alphagenic elements, such as chromium, molybdenum and silicon.

The steel according to the invention undergoes ferritic-type solidification. The ferrite solidified reverts to austenite as the steel cools down after casting. At the casting stage, the steel being cooled, the residual ferrite content in percent by volume is approximately given by the following experimentally established index:

$$FI_2=0.1106x^2+0.0331x+0.403$$

where $$x=2.52[-7.65+Cr\ \%+0.03Mn\ \%-0.864(Ni\ \%+16.10C\ \%+19.53N\ \%+0.35Cu\ \%)].$$

At this stage, the ferrite content of the steels according to the invention is less than 5%.

Next, the steel is reheated, in order to be hot rolled, at 1240° C. for 30 min. It is observed that the ferrite content is then given by the equation:

$$FI_1=0.034x^2+0.284x-0.347$$

where $$x=6.903[-6.998+Cr\ \%-0.972(Ni\ \%+21.31N\ \%+20.04C\ \%+0.46Cu\ \%+0.08Mn\ \%)].$$

The steel according to the invention preferably contains less than 20% ferrite after reheating for 30 min at 1240° C.

After hot rolling and overhardening at 1100° C. for 30 min., the steel according to the invention has a ferrite content of less than 5%. After hot working, annealing, cold working and annealing, a steel is obtained which has only a trace of residual ferrite.

The austenite/ferrite ratio was measured by saturation magnetization or by X-ray diffraction analysis.

From the standpoint of the role of the elements contained in the composition, carbon is limited to a content of less than 0.1% in order to avoid sensitizing the steel to intergranular corrosion after treatment at temperatures between 550° C. and 800° C. Preferably, the carbon content is less than 0.08% for the same reason.

Nitrogen and carbon have a similar effect on the mode of solidification, the equilibrium of the ferrite and austenite phases and the stability of the austenite with respect to martensite formation, although nitrogen has a slightly more austenizing character than carbon.

Manganese increases the solubility of nitrogen. A minimum content of 5% of this element is necessary in order to dissolve enough nitrogen and to guarantee that the steel has an austenitic structure. A 9% upper limit of the manganese content in the composition of the steel of the invention is related to the use, in the smelting of the steel according to the invention, of carburized ferro-manganese, preferably refined ferro-manganese. The effect of manganese on the amount of ferrite is constant for contents of between 5% and 9%. Furthermore, the manganese content must also be limited in order to prevent deterioration of the hot ductility.

Silicon is intentionally limited to less than 1%, and preferably to less than 0.7%, in order to prevent the formation of ferrite and to have satisfactory behavior of the steel during pickling. The 0.1% minimum content is necessary in smelting and 0.5% minimum content is preferable in order to prevent the formation of olivine-type oxide. This is because, during conversion of the steel by hot rolling, low-melting-point oxides of the olivine ($FeO/SiO_2/MnO$) type form on a steel according to the invention and containing only a low silicon content, for example less than 0.5%.

If the silicon content is less than 0.5%, a hybrid zone having a metal matrix containing these oxides in the liquid state is formed during the hot-rolling operation. This results in a poor surface finish of the steel strip, especially after pickling.

In order to prevent the formation of these low-melting-point oxides, it has proved necessary to enrich the composition of the steel with silicon to a level above 0.5%. Oxides with a high melting point are then formed, which no longer cause a surface-finish problem during hot rolling.

Silicon is limited to a content of less than 2%, and preferably less than 1%, as, taking into account the other elements of the composition, it does not contribute to the formation of an austenitic structure when its content is higher.

Nickel is an essential element in austenitic steels in general, and the posed problem of the invention is, in particular, to obtain an austenitic steel containing little nickel, an element which is expensive, the price of which is highly variable and uncontrollable, and which, because of the price fluctuations, disturbs the proper operation of the enterprise responsible for producing the steel. Nickel also has the drawback of increasing the sensitivity to stress corrosion of austenitic steels. We have also found that limiting the nickel content has allowed us to produce a new generation of steels having improved properties, as will be described below.

A chromium content greater than 13%, and preferably greater than 15%, is necessary in order to guarantee corrosion resistance of the stainless steel.

The 19%, and preferably 17%, limit of the chromium content is related to the fact that the steel according to the invention must remain with a ferrite content of less than 5% after the overhardening treatment. Chromium contents greater than 19% result in excessively high ferrite contents which do not guarantee a sufficient tensile elongation.

A minimum of 1% copper is necessary to guarantee an austenitic-type structure because of the reduction in the nickel content. Above a 4% copper content, the forgeability of the steel deteriorates significantly and hot conversion of said steel becomes difficult. Copper has approximately 40% of the austenizing effect of nickel.

Also to guarantee an austenitic-type structure in the steel according to the invention, a nitrogen content of at least 0.1% is required. Above a 0.4% nitrogen content, bubbles of this gas, called "blowholes", form within the steel during solidification.

The necessary nitrogen content may be high when molybdenum with contents of less than 2% is introduced into the composition of the steel in order to improve the corrosion resistance. Molybdenum contents greater than 2% require the addition of more than 0.4% of nitrogen in order to avoid the presence of ferrite, which is not realizable when smelting the steel at normal pressure.

The composition of the steel according to the invention contains boron in an amount of between $5\times10^{-4}$% and $50\times10^{-4}$%. The addition of boron to the composition consequently improves the hot ductility, especially between 900° C. and 1150° C., as is shown by the hot tensile reduction-in-section characteristics as a function of temperature. Above $50\times10^{-4}$% of boron, too great a reduction in the burning point occurs, that is to say that there is a risk of areas of liquid metal forming during the reheat before rolling.

Sulfur is introduced into the steel in an amount of less than 0.01% in order to ensure that the steel has a satisfactory pitting corrosion behavior.

Preferably, the sulfur content is less than $20\times10^{-4}$%, which appreciably improves the hot ductility at 1000° C. and above.

The low sulfur content may be obtained by the controlled use of calcium and aluminum, generating final aluminum contents of less than 0.03% and preferably less than $50\times10^{-4}$% or less than $30\times10^{-4}$% and calcium contents of $10\times10^{-4}$% and preferably less than $5\times10^{-4}$%, the oxygen content which results therefrom generally ranging from $20\times10^{-4}$ to $60\times10^{-4}$%.

The phosphorus content is limited to 0.05%, as in most austenitic stainless steels, in order to limit segregation during the solidification of welds and hot tearing phenomena which may consequently occur while the welds are cooling.

The steel according to the invention is compared in the description with an AISI 304 type steel called "reference" steel. The composition of the steel according to the invention is given in Tables 1 and 2 of Annexes 1 and 2 below in Table 7.

In the description, the compositions of the steel according to the invention are indicated by an asterisk.

Table 3 below gives the calculated values of the indices $FI_1$, $FI_2$ and SI for various steels.

TABLE 3

| Steel | $FI_1$ | $FI_2$ | SI |
|---|---|---|---|
| *567 | 5.1 | 6.3 | 5.1 |
| 569 | 0.9 | 3.6 | 15.1 |
| 570 | 43.6 | 25.7 | 15.1 |
| 571 | 25.1 | 18.3 | 5.6 |
| 572 | 19.0 | 12.1 | 75.9 |
| 574 | 2.7 | 5.7 | 2.8 |
| 577 | 13.1 | 12.8 | −4.9 |
| 578 | 2.9 | 4.9 | 32.4 |
| 579 | −0.9 | 2.4 | 1.5 |
| *580 | 8.6 | 9.0 | 3.7 |
| 583 | −0.2 | 4.4 | 4.1 |
| *584 | 5.7 | 7.5 | 4.3 |
| *585 | −0.6 | 2.4 | 1.7 |
| 587 | 0.9 | 0.5 | −1.9 |
| *588 | 11.8 | 11.8 | −2.1 |
| 590 | 7.5 | 9.5 | 4.0 |
| *592 | −0.8 | 2.2 | −2.6 |
| 594 | 1.5 | 0.5 | −4.4 |

TABLE 3-continued

| Steel | $FI_1$ | $FI_2$ | SI |
|---|---|---|---|
| 596 | −0.7 | 2.5 | −4.8 |
| *653 | 6.5 | 7.9 | 4.2 |
| *654 | 6.3 | 7.9 | 4.3 |
| 662 | 24.2 | 17.6 | 7.6 |
| 667 | 40.4 | 24.5 | 13.7 |
| *720 | 0.3 | 4.1 | −4.8 |
| *723 | 3.5 | 6.0 | 7.1 |
| 768 | 0.2 | 3.6 | 3.4 |
| *769 | 0.8 | 4.1 | 5.8 |
| *771 | 2.6 | 5.5 | 5.1 |
| 774 | −0.4 | 3.0 | 0.3 |
| *775 | 1.6 | 4.5 | 5.8 |
| *783 | 1.0 | 4.3 | 4.9 |

Table 4 gives the measured values of $FI_2$, $FI_1$ and the measured SI value for martensite formed after a tensile strain of 30%.

TABLE 4

| STEEL | $FI_2$ | $FI_1$ | Post-overhardening ferrite (%) | Post-tension martensite (%) |
|---|---|---|---|---|
| *567 | 2.7 | 9.9 | 0.2 | 2.6 |
| 569 | 0.7 | 0.3 | 0.2 | 13.3 |
| 570 | 17.1 | 42.8 | 0.2 | — |
| 571 | 9.9 | 25.5 | 10.9 | — |
| 572 | 6.7 | 21.0 | 4.4 | 75.8 |
| 574 | 0.9 | 1.4 | 0.2 | 1.2 |
| 577 | 4.9 | 12.0 | 4.6 | 1.2 |
| 578 | 0.7 | 1.3 | 0.3 | 37.8 |
| 579 | 0.2 | 0.2 | 0.2 | 0.4 |
| *580 | 3.4 | 9.0 | 0.6 | 2.6 |
| 583 | 0.8 | 0.8 | 0.2 | 0.1 |
| *584 | 2.0 | 6.8 | 0.3 | 1.5 |
| *535 | 0.3 | 0.2 | 0.2 | 0.3 |
| 587 | 0.2 | 0.2 | 0.2 | 0.9 |
| *588 | 3.9 | 12.9 | 2.9 | — |
| 590 | 2.2 | 7.0 | 0.2 | 2.4 |
| *592 | 0.4 | 0.2 | 0.2 | 0.4 |
| 594 | 0.2 | 0.2 | 0.2 | 0.2 |
| 596 | 0.3 | 0.2 | 0.2 | 0.2 |
| 671 | 3.3 | 3.7 | 0.2 | 7.0 |

Hot Properties of the Steel according to the Invention

The hot ductility was measured in hot tensile tests. The measurements were carried out on an as-solidified steel and on a worked-and-annealed steel.

The worked steel is obtained by forging at a start temperature of 1250° C. The steel is then annealed at a temperature of 1100° C. for 30 min. The thermal cycle of the tensile test consists of a temperature rise to 1240° C. at a rate of 20° C./s, a temperature hold at 1240° C. for one minute and a fall at a rate of 2° C./s down to the deformation temperature. The diametral reduction in section is measured, this corresponding to the ratio, expressed in %, of the difference between the initial diameter and the final diameter to the initial diameter.

FIG. 1 shows the reduction-in-section behavior as a function of the deformation temperature for steels 769-(B) and 771 -(C) according to the invention compared with low-sulfur steel 774-(D), boron-free steel 768-(A) and steel 671 called the "reference" steel (AISI 304).

Steel 768-(A), containing $30\times10^{-4}$% sulfur and no boron, has a markedly lower hot ductility than the reference steel. The same applies to steel 774-(D) containing $9\times10^{-4}$% sulfur and no boron. The addition of boron improves the ductility between 900° C. and 1050° C., as shown in the FIGURE.

Furthermore, it should be pointed out that, when boron is present, steel 771-(C) having a sulfur content of less than $20\times10^{-4}$% has a superior hot ductility characteristic over the entire temperature range between 900° C. and 1250° C. and approaches the ductility of the reference steel 671.

Mechanical Properties of the Steel according to the Invention, at Ambient Temperature The mechanical properties were measured on an annealed worked steel. The steel is worked by forging starting at 1250° C. The steel is then annealed at a temperature of 1100° C. for 30 min. in a salt bath. The test pieces used for the tensile test have a gauge part 50 mm in length with a circular cross section 5 mm in diameter. They are pulled at a rate of 20 mm/minute. The steels according to the invention have an elongation of between 55% and 67%. By way of comparison, Table 5 below gives the measured properties of the steel according to the invention, of low-nickel-content steels outside the invention and of a reference steel of the AISI 304 type.

TABLE 5

Mechanical Properties

| Heat | $R_{p0.2}$ (Mpa) | Rm (MPa) | A % | d(ln(σ) d(ln(ε) |
|---|---|---|---|---|
| *567 | 282 | 623 | 66.0 | 0.479 |
| 569 | 309 | 747 | 62.7 | 0.615 |
| 570 | 393 | 657 | 54.8 | 0.319 |
| 571 | 376 | 703 | 57.5 | 0.395 |
| 572 | 294 | 1010 | 33.7 | |
| 574 | 323 | 679 | 66.0 | 0.483 |
| 577 | 348 | 688 | 59.4 | 0.395 |
| 578 | 331 | 800 | 55.9 | 0.59 |
| 579 | 343 | 690 | 62.5 | 0.438 |
| *580 | 330 | 681 | 61.9 | 0.42 |
| 583 | 345 | 651 | 58.8 | 0.378 |
| *584 | 325 | 686 | 64.2 | 0.454 |
| *585 | 342 | 679 | 61.3 | 0.403 |
| 587 | 287 | 528 | 62.0 | 0.434 |
| *588 | 365 | 705 | 57.6 | 0.357 |
| 590 | 380 | 757 | 62.9 | 0.457 |
| *592 | 330 | 660 | 60.6 | 0.397 |
| 594 | 266 | 599 | 58.5 | 0.387 |
| 596 | 316 | 660 | 63.7 | |
| *654 | 341 | 700 | 65.0 | 0.467 |
| 662 | 375 | 830 | 42.4 | |
| 667 | 375 | 700 | 61.4 | 0.423 |
| 671 | 232 | 606 | 67.0 | 0.587 |
| AISI 304 | 230 | 606 | 67 | |

The amount of martensite after a true tensile strain of 30% was measured (Table 4). In the case of the steel according to the invention, it is less than 20%.

No trace of ε-martensite was observed in the test pieces of the steel according to the invention deformed to failure. The steels according to the invention, the SI index of which is less than 20 and the $FI_1$ index of which is less than 20, have a tensile elongation of greater than 55% after the conversion as defined above. Such an elongation is necessary in order to obtain a suitable cold ductility.

Corrosion Resistance

In the field of intergranular corrosion, a test according to the ASTM 262 E standard was carried out on steels having variable carbon and nitrogen contents. The steels on which the test is carried out are steels in the form of a 3 mm thick hot-rolled strip annealed at 1100° C. (overhardening).

Next, the steels are subjected to one of the following two sensitizing treatments:

a) A 30-minute anneal at 700° C. followed by a water quench or b) a 10-minute anneal at 650° C. followed by a water quench.

The results of the test are given in Table 6 below.

TABLE 6

| | a 700° C./30 min. + water quench | | | b 650° C./30 min. + water quench | | |
|---|---|---|---|---|---|---|
| Steel | Loss of mass (mg) | Cracks (μm) | Test | Loss of mass (mg) | Cracks (μm) | Test |
| 721 | 4.6 | 0 | Good | 2.7 | — | Good |
| *567 | 4.8 | 20 | Good | — | — | Good |
| *592 | 4.95 | 65 | Good | — | — | Good |
| *584 | 27.7 | 2500 | Poor | 3.3 | 0 | Good |
| 594 | 70.6 | 2500 | Poor | 5.4 | 22 | Poor |
| 596 | 68.9 | 2500 | Poor | 9.4 | 1250 | Poor |

The steels outside the invention, containing more than 0.1% carbon, such as steels 594 and 596, do not have acceptable properties.

The steels according to the invention, which contain less than 0.1% carbon in their composition, such as steels 567, 592 and 584, are comparable to the AISI 304 steel in terms of intergranular corrosion in the case of Test b.

Only the steels according to the invention containing less than 0.080% carbon in their composition are comparable to the AISI 304 steel in the case of Test a. The carbon content according to the invention is therefore limited to less than 0.1% and preferably limited to less than 0.08%.

Steels according to the compositions in Table 7, Annex 3, having variable aluminum, calcium, oxygen and sulfur contents, were produced in an electric furnace and with AOD, these contents having been measured using particularly accurate methods such as atomic absorption spectroscopy in the case of calcium and glow-discharge spectroscopy in the case of aluminum; using worked products, pitting corrosion tests were carried out in 0.02M NaCl at 23° C. at a pH of 6.6, the results of which are given in Table 7. The potential E1 corresponds to the probability of 1 pit per $cm^2$.

It may be seen that the pitting potential is appreciably higher in steels whose composition has an aluminum content not exceeding $50\times10^{-4}$% and which furthermore contain less than $10\times10^{-4}$% calcium, less than $60\times10^{-4}$% oxygen and less than $20\times10^{-4}$% sulfur.

It has also been able to be observed, using scanning electron microscopy, that steels A and B, having $110\times10^{-4}$% aluminum and $115\times10^{-4}$% inclusion in their composition, contain inclusions of the aluminate of lime type and of the alumina-magnesia type, these inclusions being surrounded by calcium sulfides, the sizes of which may be as much as several micrometers. No calcium sulfide was found in steels C and D containing less than $30\times10^{-4}$% aluminum and less than $10\times10^{-4}$% calcium.

French patent application 97 09 617 is incorporated herein by reference.

ANNEX 3

| Steel | C % | Si % | Mn % | Ni % | Cr % | Mo % | Cu % | S ppm | P % | $N_2$ % | V % | Co % | Al ppm | Ca ppm | $O_2$ ppm | Boron ppm |
|---|---|---|---|---|---|---|---|---|---|---|---|---|---|---|---|---|
| A | 0.050 | 0.774 | 7.58 | 1.6 | 16.75 | 0.039 | 3.02 | 3 | 0.021 | 0.200 | 0.110 | 0.029 | 110 | 11 | 30 | 25 |
| B | 0.049 | 0.794 | 7.47 | 1.59 | 16.32 | 0.080 | 2.88 | 5 | 0.025 | 0.193 | 0.059 | 0.037 | 115 | 11 | 25 | 21 |
| C | 0.052 | 0.805 | 7.65 | 1.58 | 16.45 | 0.075 | 3.11 | 8 | 0.023 | 0.186 | 0.088 | 0.075 | 20 | 4 | 35 | 22 |
| D | 0.047 | 0.786 | 7.61 | 1.59 | 16.54 | 0.068 | 3.04 | 3 | 0.025 | 0.195 | 0.081 | 0.044 | 15 | 2 | 30 | 27 |

ANNEX 1

| heat | C | Si | Mn | Ni | Cr | Mo | Cu | S ppm | P | $N_2$ | V | Co | Al % | Ca ppm | $O_2$ ppm | Boron ppm |
|---|---|---|---|---|---|---|---|---|---|---|---|---|---|---|---|---|
| *567 | 0.047 | 0.408 | 8.500 | 1.586 | 15.230 | 0.033 | 2.953 | 25 | 0.023 | 0.119 | 0.081 | 0.050 | 0.012 | 6 | 64 | 12 |
| 569 | 0.116 | 0.406 | 6.509 | 1.621 | 15.270 | 0.048 | 2.413 | 21 | 0.023 | 0.115 | 0.069 | 0.042 | 0.011 | 7 | 41 | 22 |
| 570 | 0.047 | 0.398 | 8.583 | 0.501 | 17.170 | 0.046 | 2.421 | 32 | 0.024 | 0.115 | 0.076 | 0.039 | <0.010 | <5 | 85 | <5 |
| 571 | 0.114 | 0.376 | 6.490 | 0.493 | 17.450 | 0.045 | 2.997 | 9 | 0.023 | 0.115 | 0.072 | 0.043 | 0.026 | 17 | 30 | <5 |
| 572 | 0.049 | 0.389 | 6.469 | 0.495 | 15.300 | 0.044 | 2.405 | 12 | 0.023 | 0.115 | 0.072 | 0.046 | 0.023 | <5 | 42 | 27 |
| 574 | 0.117 | 0.425 | 8.482 | 0.497 | 15.240 | 0.046 | 2.999 | 15 | 0.025 | 0.125 | 0.077 | 0.041 | 0.011 | 12 | 28 | 13 |
| 577 | 0.116 | 0.421 | 8.508 | 1.628 | 17.360 | 0.046 | 2.407 | 27 | 0.024 | 0.118 | 0.075 | 0.039 | 0.012 | 6 | 40 | 19 |
| 578 | 0.048 | 0.396 | 6.469 | 0.503 | 15.420 | 0.047 | 3.004 | 26 | 0.025 | 0.204 | 0.072 | 0.045 | <0.01 | <5 | 91 | <5 |
| 579 | 0.114 | 0.429 | 8.513 | 0.503 | 15.410 | 0.049 | 2.410 | 22 | 0.024 | 0.210 | 0.078 | 0.041 | 0.021 | 8 | 29 | 19 |
| *580 | 0.051 | 0.414 | 6.427 | 1.624 | 17.420 | 0.052 | 2.409 | 8 | 0.024 | 0.215 | 0.078 | 0.043 | 0.028 | 19 | 30 | 23 |
| 583 | 0.155 | 0.391 | 8.528 | 1.619 | 17.310 | 0.051 | 2.999 | 10 | 0.024 | 0.214 | 0.072 | 0.038 | 0.026 | 16 | 32 | 17 |
| *584 | 0.081 | 0.398 | 7.466 | 1.067 | 16.280 | 0.037 | 2.702 | 15 | 0.024 | 0.167 | 0.074 | 0.042 | 0.020 | 14 | 31 | 22 |
| *585 | 0.044 | 0.404 | 8.479 | 1.629 | 15.440 | 0.046 | 2.434 | 34 | 0.024 | 0.212 | 0.077 | 0.042 | 0.012 | <5 | 58 | 15 |
| 587 | 0.113 | 0.378 | 6.535 | 1.633 | 15.230 | 0.046 | 3.020 | 19 | 0.025 | 0.206 | 0.074 | 0.044 | 0.016 | 18 | 39 | 12 |
| *588 | 0.050 | 0.381 | 8.440 | 0.532 | 17.070 | 0.048 | 3.027 | 14 | 0.023 | 0.211 | 0.072 | 0.040 | 0.016 | 12 | 44 | 15 |
| 590 | 0.114 | 0.429 | 6.476 | 0.496 | 17.420 | 0.044 | 2.420 | 9 | 0.023 | 0.215 | 0.076 | 0.041 | 0.022 | 19 | 36 | 26 |
| *592 | 0.046 | 0.429 | 8.485 | 1.606 | 15.380 | 0.045 | 3.009 | 24 | 0.024 | 0.202 | 0.076 | 0.040 | 0.020 | 10 | 41 | 26 |

-continued

ANNEX 1

| heat | C | Si | Mn | Ni | Cr | Mo | Cu | S ppm | P | $N_2$ | V | Co | Al % | Ca ppm | $O_2$ ppm | Boron ppm |
|---|---|---|---|---|---|---|---|---|---|---|---|---|---|---|---|---|
| 594 | 0.107 | 0.404 | 8.498 | 1.627 | 15.280 | 0.046 | 3.002 | 20 | 0.024 | 0.215 | 0.075 | 0.041 | 0.013 | 9 | 49 | 23 |
| 596 | 0.116 | 0.398 | 8.556 | 1.622 | 15.280 | 0.045 | 3.014 | 19 | 0.024 | 0.130 | 0.074 | 0.040 | 0.015 | 12 | 45 | 19 |

ANNEX 2

| Heat | C | Si | Mn | Ni | Cr | Mo | Cu | S ppm | P | $N_2$ | V | Co | Al % | Ca ppm | $O_2$ ppm | Boron ppm |
|---|---|---|---|---|---|---|---|---|---|---|---|---|---|---|---|---|
| *653 | 0.084 | 0.420 | 7.476 | 1.060 | 16.330 | 0.049 | 2.678 | 35 | 0.024 | 0.162 | 0.078 | 0.041 | 0.012 | 5 | 47 | 18 |
| *654 | 0.084 | 0.432 | 7.454 | 1.062 | 16.320 | 0.045 | 2.691 | 32 | 0.022 | 0.162 | 0.077 | 0.041 | 0.015 | 7 | 43 | 21 |
| 662 | 0.114 | 0.432 | 6.448 | 0.491 | 17.260 | 0.044 | 3.018 | 7 | 0.024 | 0.115 | 0.073 | 0.041 | <0.010 | <5 | 59 | 18 |
| 667 | 0.051 | 0.470 | 8.469 | 0.477 | 17.260 | 0.470 | 2.390 | 7 | 0.021 | 0.127 | 0.077 | 0.038 | <0.010 | <5 | 61 | 12 |
| *720 | 0.068 | 0.419 | 8.425 | 1.665 | 16.410 | 0.047 | 3.049 | 29 | 0.025 | 0.202 | 0.074 | 0.040 | 0.010 | 12 | 52 | 20 |
| *723 | 0.069 | 0.415 | 8.311 | 0.557 | 15.460 | 0.051 | 3.022 | 27 | 0.025 | 0.170 | 0.077 | 0.035 | 0.012 | 14 | 39 | 23 |
| 768 | 0.071 | 0.758 | 8.522 | 0.512 | 15.280 | 0.049 | 3.036 | 30 | 0.025 | 0.200 | 0.077 | 0.039 | <0.010 | <5 | 55 | <5 |
| *769 | 0.075 | 0.788 | 8.522 | 0.508 | 15.130 | 0.052 | 3.006 | 35 | 0.027 | 0.180 | 0.073 | 0.043 | 0.015 | 6 | 42 | 25 |
| *771 | 0.075 | 0.787 | 8.608 | 0.487 | 15.340 | 0.048 | 3.021 | 9 | 0.029 | 0.170 | 0.079 | 0.042 | 0.025 | 17 | 28 | 29 |
| 774 | 0.075 | 0.762 | 8.548 | 0.792 | 15.270 | 0.049 | 3.015 | 9 | 0.026 | 0.196 | 0.073 | 0.038 | 0.010 | <5 | 60 | <5 |
| *775 | 0.071 | 0.372 | 8.523 | 0.492 | 15.280 | 0.049 | 3.022 | 32 | 0.026 | 0.181 | 0.078 | 0.041 | 0.013 | 8 | 41 | 20 |
| *713 | 0.071 | 0.704 | 8.542 | 0.488 | 15.260 | 0.051 | 3.029 | 64 | 0.023 | 0.188 | 0.072 | 0.046 | <0.010 | <5 | 79 | 31 |
| 670 | 0.094 | 0.470 | 6.389 | 4.217 | 16.270 | 0.104 | 0.082 | 28 | 0.023 | 0.166 | 0.070 | 0.059 | >0.010 | <5 | 62 | <5 |
| 671 | 0.035 | 0.393 | 1.510 | 8.550 | 18.O50 | 0.201 | 0.200 | 25 | 0.016 | 0.048 | 0.078 | 0.117 | <0.010 | <5 | 58 | <5 |
| 672 | 0.037 | 0.424 | 1.417 | 8.625 | 18.080 | 0.207 | 0210 | 10 | 0.018 | 0.043 | 0.077 | 0.117 | >0.010 | <5 | 59 | <5 |
| 721 | 0.037 | 0.385 | 1.414 | 8.577 | 17.230 | .0199 | 0.213 | 36 | 0.019 | 0.041 | 0.053 | 0.115 | <0.010 | <5 | 65 | <5 |
| 766 | 0.044 | 0.322 | 0.437 | 0.156 | 16.400 | 0.025 | 0.102 | 22 | 0.022 | 0.035 | 0.076 | 0.000 | <0.010 | <5 | 64 | <5 |

What is claimed is:

1. An austenitic stainless steel comprising the following elements in percent by weight based on total weight:

0.03%<molybdenum<2% carbon<0.1%

0.1%<silicon<1%

5%<manganese<9%

0.1%<nickel<2%

15%<chromium<19%

1% copper<4%

0.1%<nitrogen<0.40%

$5\times10^{-4}$%<boron<$50\times10^{-4}$% phosphorus<0.05% sulfur<0.01% and iron and impurities resulting from smelting, wherein the composition satisfies the following relationship, where SI is the martensite stability index:

$$SI=0.0267x^2+0.4332x-3.1459<20,$$

where $$x=250.4-205.4C\ \%-101.4N\ \%-7.6Mn\ \%-12.1Ni\ \%-6.1Cr\ \%-13.3Cu\ \%.$$

2. The austenitic steel as claimed in claim 1, wherein the composition satisfies the following relationship, where $FI_1$ is the ferrite index:

$$FI_1=0.034x^2+0.284x-0.347<20,$$

where $$x=6.903[-6.998+Cr\ \%-0.972(Ni\ \%+20.04C\ \%+21.31N\ \%+0.46Cu\ \%+0.08Mn\ \%)].$$

3. The austenitic steel as claimed in claim 1, which comprises less than 1% nickel.

4. The austenitic steel as claimed in claim 1, which comprises from 15% to 17% chromium.

5. The austenitic steel as claimed in claim 1, which comprises less than 0.08% carbon.

6. The austenitic steel as claimed in claim 1, which comprises from 0.5% to 0.7% silicon.

7. The austenitic steel as claimed in claim 1, which furthermore comprises less than 0.0020% sulfur.

8. The austenitic steel as claimed in claim 1, which furthermore comprises less than 0.030% aluminum and less than $20\times10^{-4}$% calcium.

9. The austenitic steel as claimed in claim 1, which furthermore comprises less than $50\times10^{-4}$% aluminum and less than $5\times10^{-4}$% calcium.

10. The austenitic steel as claimed in claim 2, which comprises less than 1% nickel.

11. The austenitic steel as claimed in claim 1, which comprises less than 1% nickel.

12. The austenitic steel as claimed in claim 2, which comprises from 15% to 17% chromium.

13. The austenitic steel as claimed in claim 1, which comprises from 15% to 17% chromium.

14. The austenitic steel as claimed in claim 2, which comprises less than 0.08% carbon.

15. The austenitic steel as claimed in claim 1, which comprises less than 0.08% carbon.

16. The austenitic steel as claimed in claim 2, which comprises from 0.5% to 0.7% silicon.

17. The austenitic steel as claimed in claim 1, which comprises from 0.5% to 0.7% silicon.

18. The austenitic steel as claimed in claim 1, which comprises less than 20% martensite after a true tensile strain of 30%.

* * * * *